US011426016B2

(12) United States Patent
Stenberg

(10) Patent No.: US 11,426,016 B2
(45) Date of Patent: Aug. 30, 2022

(54) NAPKIN FOR WRAPPING CUTLERY

(71) Applicant: Essity Hygiene and Health Aktiebolag, Gothenburg (SE)

(72) Inventor: Martin Stenberg, Gothenburg (SE)

(73) Assignee: ESSITY HYGIENE AND HEALTH AKTIEBOLAG, Gothenburg (SE)

( * ) Notice: Subject to any disclaimer, the term of this patent is extended or adjusted under 35 U.S.C. 154(b) by 285 days.

(21) Appl. No.: 16/346,645

(22) PCT Filed: Nov. 1, 2016

(86) PCT No.: PCT/EP2016/076297
§ 371 (c)(1),
(2) Date: May 1, 2019

(87) PCT Pub. No.: WO2018/082761
PCT Pub. Date: May 11, 2018

(65) Prior Publication Data

US 2020/0060451 A1 Feb. 27, 2020

(51) Int. Cl.
*A47G 11/00* (2006.01)
*A47G 21/14* (2006.01)

(52) U.S. Cl.
CPC ..... *A47G 11/001* (2013.01); *A47G 21/14* (2013.01)

(58) Field of Classification Search
CPC .... A47G 11/001; A47G 11/002; A47G 21/14; A47G 21/145; A47G 21/165;
(Continued)

(56) References Cited

U.S. PATENT DOCUMENTS 2,423,581 A 7/1947 Clark
2,529,060 A * 11/1950 Trillich ..... B65D 65/40 229/87.01

(Continued)

FOREIGN PATENT DOCUMENTS

CN 102369144 A 3/2012
CN 102781287 A 11/2012

(Continued)

OTHER PUBLICATIONS

China National Intellectual Property Administration, Office Action and Search Report issued in Chinese Patent Application No. 201680090406.0 dated Jan. 6, 2020 and English translation (13 pages).

(Continued)

*Primary Examiner* — J. Gregory Pickett
*Assistant Examiner* — Abigail Elizabeth Guidry
(74) *Attorney, Agent, or Firm* — Cantor Colburn LLP

(57) ABSTRACT

A napkin is provided with an adhering portion and a releasing portion that can releasably adhere together. The adhering portion is located on an upper side of the napkin and the releasing portion is located on the lower side at a corresponding position such that the napkin can be stacked with similar napkins with the releasing portion of a first napkin aligned and engaged with the adhering portion of a second napkin. The napkin has an engaging location on its lower side such that the napkin can be wrapped around items of cutlery and secured to form a wrap by engaging the adhering portion with the engaging location. A method of wrapping cutlery using the napkin is also provided.

16 Claims, 4 Drawing Sheets

(58) Field of Classification Search
CPC .. A47G 2021/162; A47G 21/16; A45C 13/02; B65D 5/5028; B65D 73/0014; B65D 73/005; B65D 73/0064; B65D 73/0071; B65D 73/0028; B65D 75/52; B65H 45/24; A47K 10/20; A47K 10/3643; A47K 10/421; A47K 10/34; A47K 10/426; A47K 10/16; B31F 1/0016; B31F 5/005; B31D 1/04; B31D 5/04; Y10T 428/24802; Y10T 156/1051; B32B 3/04; F16B 5/0084; F16B 1/00
See application file for complete search history.

(56) References Cited

U.S. PATENT DOCUMENTS 3,398,438 A * 8/1968 Fried ..... A41B 13/10 24/7
3,654,059 A * 4/1972 Zisblatt ..... A47G 9/0238 428/41.5
3,978,553 A 9/1976 Honig
4,286,639 A * 9/1981 Murphy ..... A61F 15/001 206/440
5,011,017 A * 4/1991 Giesen ..... A47G 11/001 206/494
5,188,877 A * 2/1993 Magaro ..... B65D 81/3886 428/80
5,260,536 A * 11/1993 Peery ..... A47G 11/00 219/730
5,468,534 A * 11/1995 Godfrey ..... A47G 11/002 24/7
5,552,200 A 9/1996 Gureff
5,560,800 A * 10/1996 Liu ..... B05D 1/62 156/289
5,672,056 A * 9/1997 Fisher ..... A41B 13/10 2/49.1
6,021,550 A * 2/2000 Welch ..... A45F 5/04 24/304
6,971,218 B1 * 12/2005 Huckaba ..... B65B 13/02 53/139.1
8,651,275 B1 * 2/2014 D'Aloisio ..... A47G 21/14 206/494
8,703,270 B2 4/2014 Hummerich
2001/0006726 A1 * 7/2001 Arakawa ..... A61L 15/58 428/343
2001/0032967 A1 * 10/2001 Carlson ..... F16B 5/0084 252/408.1
2002/0051863 A1 * 5/2002 Chan ..... A47K 10/424 428/126
2002/0088592 A1 * 7/2002 Drew ..... D21F 11/14 162/297
2002/0124534 A1 * 9/2002 Heisey ..... B65B 11/105 53/466
2003/0105183 A1 * 6/2003 Sharak ..... C09J 11/00 523/102
2003/0212195 A1 * 11/2003 Matsumoto ..... C09J 7/38 156/289
2004/0224116 A1 * 11/2004 Manasa ..... A47K 10/16 428/40.1
2005/0148257 A1 * 7/2005 Hermans ..... D21H 27/005 442/327
2005/0252057 A1 * 11/2005 Lavi ..... G09F 3/14 40/665
2006/0173431 A1 * 8/2006 Laumer ..... A61L 15/60 604/372
2006/0174390 A1 * 8/2006 Wakhloo ..... A41D 13/04 2/48
2007/0061939 A1 * 3/2007 Rose ..... A41B 13/10 2/49.1
2007/0185469 A1 * 8/2007 Green ..... A47G 11/002 604/387
2007/0205212 A1 * 9/2007 Klingel ..... B65H 37/04 221/33
2008/0302066 A1 * 12/2008 Lavi ..... B65B 11/56 53/399
2009/0321552 A1 * 12/2009 Hada ..... B65D 65/14 242/583
2010/0213699 A1 * 8/2010 Tremper ..... A63F 9/001 283/117
2011/0240722 A1 * 10/2011 Stromme ..... B65D 65/06 229/87.08
2013/0086725 A1 * 4/2013 Sabre ..... A41B 13/106 2/49.2
2013/0171408 A1 * 7/2013 Carlson ..... B65H 45/24 428/121
2014/0034254 A1 * 2/2014 Qin ..... D21H 17/36 162/111
2015/0064416 A1 * 3/2015 Wolf ..... A61F 13/56 428/195.1
2015/0122408 A1 5/2015 Shaw
2015/0298420 A1 * 10/2015 Gungner ..... B31F 1/07 428/172
2018/0206558 A1 * 7/2018 Bannan ..... A41D 13/04
2021/0177171 A1 * 6/2021 Petro ..... A47G 21/165

FOREIGN PATENT DOCUMENTS

CN 103997940 A 8/2014
CO 14139635 7/2013
CO 6990698 A2 7/2014
DE 1810867 A1 * 6/1969 ..... A61F 13/72
DE 4335279 A1 4/1995
DE 29622148 U1 * 3/1997 ..... A47G 11/002
DE 102007033572 A1 1/2009
EP 1935296 A2 6/2008
FR 2784563 A1 * 4/2000 ..... A47G 11/002
FR 2787002 A3 * 6/2000 ..... A47G 11/002
GB 1148145 A * 4/1969 ..... A47G 11/002
GB 1552154 A * 9/1979 ..... A47G 11/001
GR 1006004 B 7/2008
NL 1038110 C2 1/2012
WO 2011039533 A1 4/2011
WO 2013100841 A1 7/2013
WO WO-2016102080 A1 * 6/2016 ..... B32B 7/12
WO 2018082761 A1 5/2018
WO 2019120514 A1 6/2019

OTHER PUBLICATIONS

Colombian Patent Office, Office Action issued is NC2019/0004559 dated Mar. 15, 2021 (with English translation), 16 pages.
Habeger, Jr., Chalres C., et al., "Handbook of Physical Testing of Paper," vol. 1, pp. 662 (book not available, google book link: https://books.google.com.co/books?id-Wh_KqCXPn3gC&printsec=frontcover&hl=es#v-onepage&q&f-false) 2 pages.
Sizes (Dec. 20, 2002), Napkins (https://www.sizes.com/home/napkins.htm) 1 page.
Wikipedia, "Tissue Paper" Oct. 9, 2016, https://en.wikipedia.org/w/index.php?title=Tissue_paper&oldis=743359080 (8 pages).
Andean Patent Manual. OMPI, Andean Community Secretary, 2004. ISBN-9978-43-855-6. Section 10.8.1 (no document located).
Colombia Industria Y Comercio, Office Action issued in Colombina Patent Application No. NC2019/0004559, dated Apr. 24, 2020 (8 pages).
Mark, Richard E.., et al., "Handbook of Physical Testing of Paper," vol. 1, Second Edition, pp. 662, https://books.google.com.co/books?id=Wh_KqCXPn3gC&printsec=frontcover&hl=es#v=onepage&q&f=false.
Sizes, Inc. "Napkins," Dec. 20, 2002, https://www.sizes.com/home/napkins.htm.
Wikipedia, "Tissue Paper," Oct. 9, 2016, https://en.wikipedia.org/w/index.php?title=Tissue_paper&oldid=743359080.
National Intellectual Property Administration of the People's Republic of China,2nd Office Action and Supplementary Search Report issued in CN Application No. 201680090406.0, dated Sep. 3, 2020, with English translation (18 pages).
Colombia Industria Y Comercio, Office Action issued in Colombia Patent Application No. NC2019/0004559, dated Sep. 21, 2020 with

(56) References Cited

OTHER PUBLICATIONS

English language explanation of relevance included (15 pages).
Clarkson, Paul Magnus, Response to Written Opinion and Search Report filed in International Application No. PCT/EP2016/076297 dated Aug. 31, 2018 (10 pages).
International Searching Authority, Written Opinion and Search Report issued in International Application No. PCT/EP2016/076297 dated Jul. 19, 2017 (13 pages).
International Searching Authority, Written Opinion of the International Preliminary Examining Authority issued in International Application No. PCT/EP2016/076297 dated Sep. 26, 2018 (6 pages).
Russian Patent Office, Office Action issued in Russian Patent Application No. 2019116607 dated Jul. 16, 2019 and English translation (10 pages).
Australian Government, IP Office, Examination Report No. 1 issued in AU Application No. 2017443538, dated Feb. 5, 2021 (4 pages).
Brazilian Patent Office, Office Action issued in BR Application No. BR112020009526-5, dated Mar. 9, 2022, 4 pages.
Canadian Patent Office, Office Action issued in CA Application No. 3096762, dated Mar. 2, 2022, 4 pages.
Chilean Patent Office, Office Action issued in CL Application No. 2020-001676, dated Jul. 14, 2021 (15 pages).
Chinese Patent Office, Office Action issued in CN Application No. 201780097380.7, dated Aug. 3, 2021 with English translation (18 pages).
Russian Patent Office, Notification of Examination Results issued in RU Application No. 2020121421, dated Jan. 25, 2021 with English translation (19 pages).

* cited by examiner

NAPKIN FOR WRAPPING CUTLERY

CROSS-REFERENCE TO RELATED APPLICATION

This application is a national stage entry under 35 U.S.C. § 371 of, and claims priority to, International Application No. PCT/EP2016/076297, filed Nov. 1, 2016, with the same title as listed above. The above-mentioned patent application is incorporated herein by reference in its entirety.

TECHNICAL FIELD

The present disclosure relates to table napkins and in particular relates to disposable napkins that may be used to wrap a service of cutlery as may be provided for an individual place setting in a restaurant or other catering facility.

BACKGROUND

Napkins are used in catering and the home in a variety of different forms. Cloth napkins are generally used for fine dining, whereas disposable napkins tend to be more conventional in higher volume establishments. Amongst the disposable napkins there may also be considerable variation, ranging from high-end cloth-like non-woven materials to serviettes dispensed from a bulk dispenser or roll.

One particular use of the napkin is to wrap cutlery as an individual place setting. Such wraps may be prepared in advance, containing e.g. a knife and fork or a knife, fork and spoon. The waiter or restaurant staff can then quickly provide the requisite number of wraps to a table. Alternatively, diners e.g. in a buffet setting can take their own wrap from a pile or basket.

Preparing such wraps is a time consuming exercise involving the steps of:

taking a napkin from a pile;

taking a set of cutlery and laying it on the napkin;

wrapping or rolling the napkin around the cutlery; and securing the wrap with a clip, band or sticker.

The final step of securing the connection requires an additional element such as the self-adhesive napkin bands commercially available from Royal Paper Products, Inc. Such an additional element increases the cost of the wrap and adds to the time of production. Additionally, during use, it leads to an additional item of waste that may be present on the table during the meal and is sometimes unsightly.

SUMMARY

In order to address these and other problems with conventional designs, according to the invention there is provided in one embodiment a napkin having an upper side, a lower side and four corners, the napkin being provided with an adhering portion and a releasing portion that can releasably adhere together. The adhering portion is located on the upper side and the releasing portion is located on the lower side at corresponding positions such that the napkin can be stacked with similar napkins with the releasing portion on the lower side of a first napkin aligned and engaged with the adhering portion of a second napkin located beneath the first napkin. The napkin further comprises an engaging location on its lower side such that the napkin can be wrapped around an object and secured by engaging the adhering portion with the engaging location.

As a result of the defined configuration, the napkins can be easily provided in a stack and used one by one to wrap a service of cutlery. Prior to wrapping, the adhering portion retains the napkin to the stack and on completion of the wrapping operation, the adhering portion secures the wrap and prevents the napkin from opening.

In one aspect, a suitable location for the adhering portion is at a corner of the napkin. It will be understood that this refers to the napkin in the state in which it is to be stacked. Since napkins will generally be folded, this does not mean that the adhering portion will necessarily be located at a corner of the unfolded napkin. In fact, in particular embodiments, the adhering portion will be located other than at the corner of the unfolded napkin. In the following, in order to avoid ambiguity, reference to the napkin is to the napkin as it is stacked or presented prior to wrapping an item of cutlery. In particular embodiments, the napkin has four corners. For a napkin in its unfolded state, reference is given to a sheet having points.

If the adhering portion is at a corner of the napkin, then, in particular embodiments, the releasing portion is also at a corner of the napkin. In particular embodiments, the releasing portion will be located directly below the adhering portion. However, the releasing portion may be located beneath a different corner. For example, if the adhering portion is provided on a first corner, then the releasing portion may be located beneath the diagonally opposite corner. In that case, the napkins are stacked alternately. In alternative embodiments, the releasing portion is on an adjacent corner to the adhering portion, in which case, the napkins will rotate through the stack. This rotation may be clockwise or counter clockwise. Also, the rotation may skip the immediately adjacent corner or follow a different pattern.

The engaging location is in certain embodiments located close to a centre of the napkin, although this will depend at least partially on the way of wrapping and the size of the item to be wrapped. It will be understood that the engaging location may be defined by a particular texture or coating on the napkin, facilitating engagement or release of the adhering portion. In its simplest form, it may also be an area of the lower surface of the napkin, designated to receive the adhering portion. The engagement location may also be decorated or otherwise embellished e.g. to avoid any damage to the napkin on opening the wrap from being perceived by a user.

In another aspect, the napkin may be a single sheet having a maximum extent defined by the four corners. More usually however, the napkin will include a sheet that has been folded at least once. In one embodiment, the napkin includes a sheet having an inner surface and an outer surface that has been folded at least once with the inner surface inwards. The at least one fold may bisect the sheet or be offset from the center line. In this case, it will be understood that both the adhering portion and the releasing portion will be located on the outer surface. It is noted in this context that certain napkins and the like have in the past been provided with attachment means for sticking to a user's clothing. In that case however, the attachment is provided on the inner surface of the sheet that forms the napkin. This arrangement is provided, for example, where there is a clearly defined difference e.g. in quality, pattern or texture between the inner surface and the outer surface.

In some embodiments, the sheet is twice-folded to form the napkin with the outer surface exposed and the four points of the sheet aligned at a first corner of the napkin. A large class of disposable paper napkins are of this type and of the napkins that are used for making cutlery service wraps, this is by far the most common, since it provides a wrap that is of suitable size to enclose the service and yet can be opened out to four times the area for dining. In further embodiments, the first and/or the second fold may be offset from a line bisecting the sheet. In a particular embodiment, the first fold is offset such that two of the points, in particular the two outer points, are aligned at a first corner and the other two points are aligned at a location interior of the first corner.

In a further aspect, for a twice-folded napkin, there are two corners that are preferred for providing the adhering portion, since they lead to a wrap that is less likely to open. These are the two corners that lie on the second fold of the twice-folded napkin and may be referred to as the "closed" corners. In a first embodiment the adhering portion may be provided adjacent a second corner of the napkin, diagonally opposite to the first corner. This is the corner closest to the centre of the sheet. In this case, the engaging location may be provided between the first corner and a centre of the napkin. An alternative to this arrangement is for the adhering portion to be located at or adjacent a third corner of the napkin with the engaging location being provided between a fourth corner and a centre of the napkin. In this case, the third and fourth corners are the adjacent corners to the first corner, with the third corner being the "closed" corner.

All of the above assumes that the napkin is wrapped around the cutlery service along a diagonal of the napkin. It will nevertheless, be understood that other methods of wrapping may be applied e.g. parallel to a side of the napkin. In that case, the adhering portion may be located at a different location and the releasing portion and engaging location will be positioned accordingly.

In yet further embodiments, the sheet may have three or four folds, with each fold bisecting the sheet or being offset from a bisecting line. The three folded napkin may include two parallel folds and a third perpendicular fold, with the first two folds being C- or Z-folded. Alternatively, the first fold may be the perpendicular fold and the second two folds may be the parallel folds in a C- or Z-fold pattern. Yet further, the three folded napkin may be folded in a manner similar to the twice-folded napkin followed by an additional bisecting or offset fold.

The sheet that forms the napkin may be manufactured of any suitable material and the skilled person will choose the material according to the quality and intended use required of the napkin. In particular, the sheet may be manufactured of one or several layers or plies of fibrous material, for example cellulose-based absorbent material, such as tissue or air-laid, including dry crepe, wet crepe and structured tissue. It is also possible to use fibrous materials which entirely or partially consist of synthetic single- or multi-component fibres and/or regenerated cellulose fibres, such as fibres including polyamide, polypropylene, polyethene, polyester, viscose, etc. Multi-ply napkins may be laminated in a conventional way by co-embossing of the component plies or by gluing. In one embodiment the sheet is multi-ply tissue having a weight per ply of between 14 g/m2 and 30 g/m2, preferably between 15 g/m2 and 24 g/m2 or even more preferably between 16 g/m2 and 18 g/m2. In another embodiment, the napkin is formed by folding a sheet of single-ply air-laid non-woven having a weight of between 25 g/m2 and 80 g/m2, preferably between 30 g/m2 and 70 g/m2 or even more preferably between 40 g/m2 and 60 g/m2. In a further embodiment the sheet is single-ply tissue having a weight of between 14 g/m2 and 40 g/m2, preferably between 16 g/m2 and 30 g/m2 or even more preferably between 18 g/m2 and 22 g/m2

The napkin may be any suitable size according to the desired use. With reference to the unfolded size of the sheet, the sheet may have maximum dimensions of between 20 cm and 60 cm, including cocktail size (20 cm×20 cm), lunch size (30 cm×30 cm), standard size (40 cm×40 cm), luxury size (50 cm×50 cm) or any other intermediate size required. In general, the sheet may be square. In this context, square is intended to cover shapes that the user will perceive as being square even though adjacent sides may not be equal. In certain circumstances, the sheet may be non-square even though the napkin is folded to a square or vice-versa.

It is also understood that the outer surface of the sheet from which the napkin is formed may be patterned, e.g. printed or embossed, to distinguish it from the inner surface. In this context, we may refer to the fact that the outer surface is the quality surface that is intended to be visible e.g. when the napkin is presented and when it is placed on a user's lap. The embossing may have taken place onto the outer surface, which is sometimes referred to as the female side. The adhering portion may be provided on this outer surface as may be both the releasing portion and the engaging location. For this reason, it may be important to ensure that these portions are of an acceptable visual appearance both before use, when wrapped, and during use.

The adhering portion may be designed to retain the engaging portion for at least 24 h, while at the same time being possible to separate the two portions without destroying one or both of them. It may e.g. be a pressure-sensitive, hot-melt adhesive or a water-based acrylic adhesive. In certain embodiments, the adhering portion may be transparent or may be in itself decorative. It may be circular, square, triangular and of any size suitable for its function. It may be a logo or a print of motif. The same may apply to the releasing portion, which may be the same size as or larger than the adhering portion. The engaging location will generally be significantly larger, since it is configured to allow for variations in wrapping. It is also not excluded that the engaging location extends to and includes the releasing portion. Application of the adhering portion may take place by any suitable method according to the material of the napkin and the type of adhering portion. This may include gravure, spray, roll or slot coating processes or by printing, at any stage in the manufacture of the napkin. The shape of the adhering portion may be dependent upon the process used for its application. In many embodiments, the adhering portion will be applied at a late stage in the procedure, e.g. immediately before, during or after folding. The releasing portion and/or engaging location may be similarly provided. Examples of materials for the releasing portion include silicone sprays, silicon kit and varnishes.

In a still further embodiment, the adhering portion and the releasing portion may be provided on separate elements such as stickers or tape portions that are applied to the napkin during production. The adhering portion may be double sided adhesive tape with a first adhesive side and a second tacky side. The releasing portion may be single sided adhesive with the second side having a repellent portion that releases easily from the tacky adhesive. Both portions may be provided on a single tape element.

The engaging portion may be arranged to increase the strength properties of the napkin surface and/or between layers via e.g. coating, embossing or lamination. The engaging portion may also be designed to facilitate adhering and releasing between the adhering portion and the engaging portion via e.g. embossing, coating or printing. In one embodiment, the engaging location may include a protective surface facilitating release of the adhering portion without damage to the napkin. The protective surface may be a region in which a shiny or glossy finish is provided to the napkin material. It will be understood that such a surface may be less absorbent than other regions of the napkin and for this reason, it may not be desirable for the engaging location to extend over a large area of the napkin. Alternatively, the protective surface may not affect the comfort and adsorption of the napkin material and in which case, it may extend over a larger portion of the napkin and may even be coextensive with the outer surface of the sheet forming the napkin.

In another embodiment, the napkin may make use of adhesives or materials that engage to each other but not to other surfaces. Examples of such materials may include the well-known hook and loop fasteners such as Velcro®, although alternatives exist based on tacky adhesives that only stick to each other. Such adhesives are sometimes referred to as envelope-glue and may be based on two component epoxy adhesive, which only sticks in case of mutual contact, or other types of male-female connections which adhere to each other but not to their environment. In this case, the adhering portion and the engaging location and/or the releasing portion are provided with complementary surfaces that releasably adhere to each other but do not adhere to the napkin material.

The invention also relates to a stack of napkins as defined above or hereinafter, piled together with the releasing portions on the lower sides of the napkins aligned and releasably engaged with the adhering portion of an adjacent napkin in the stack. Advantageously, because of the relation between the releasing portion and the adhering portion, there is no requirement for a cover paper to be removed from the adhering portion prior to its use and the stack may consist only of napkins. It is of course not excluded that there may be a cover paper of the uppermost adhering portion prior to use and or other wrapping or packaging materials for the stack.

The disclosure still further relates to a cutlery wrap including one or more items of cutlery, wrapped in a napkin, the wrap being secured by engagement of an adhering portion on the napkin with an engaging location at another position on the napkin. In this manner, a cutlery wrap may be achieved without the use of any additional element such as a ring, clip or sticker to hold the wrap together.

Furthermore a method of wrapping cutlery to form a cutlery wrap is disclosed, the method including:

- providing a napkin having an adhering portion;
- placing one or more items of cutlery onto the napkin;
- wrapping the cutlery in the napkin; and
- engaging the adhering portion with an engagement location on the napkin to secure the wrap.

The napkin may be a napkin as described above or hereinafter.

In a particularly convenient manner of forming the wrap, the napkin is provided in a stack with the upper side of the top napkin exposed and the items of cutlery are placed onto the upper side of the top napkin.

A napkin is also disclosed, having an upper side, a lower side and four corners, the napkin including a twice-folded sheet and being provided with an adhering portion on the upper side, adjacent to one of the corners and a releasing portion on the lower side at a corresponding position to the adhering portion such that a plurality of napkins may be stacked together with the releasing portion of a first napkin engaging releasably with the adhering portion of a second napkin located beneath the first napkin.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, explain the one or more embodiments of the invention.

DETAILED DESCRIPTION

Figure 1:
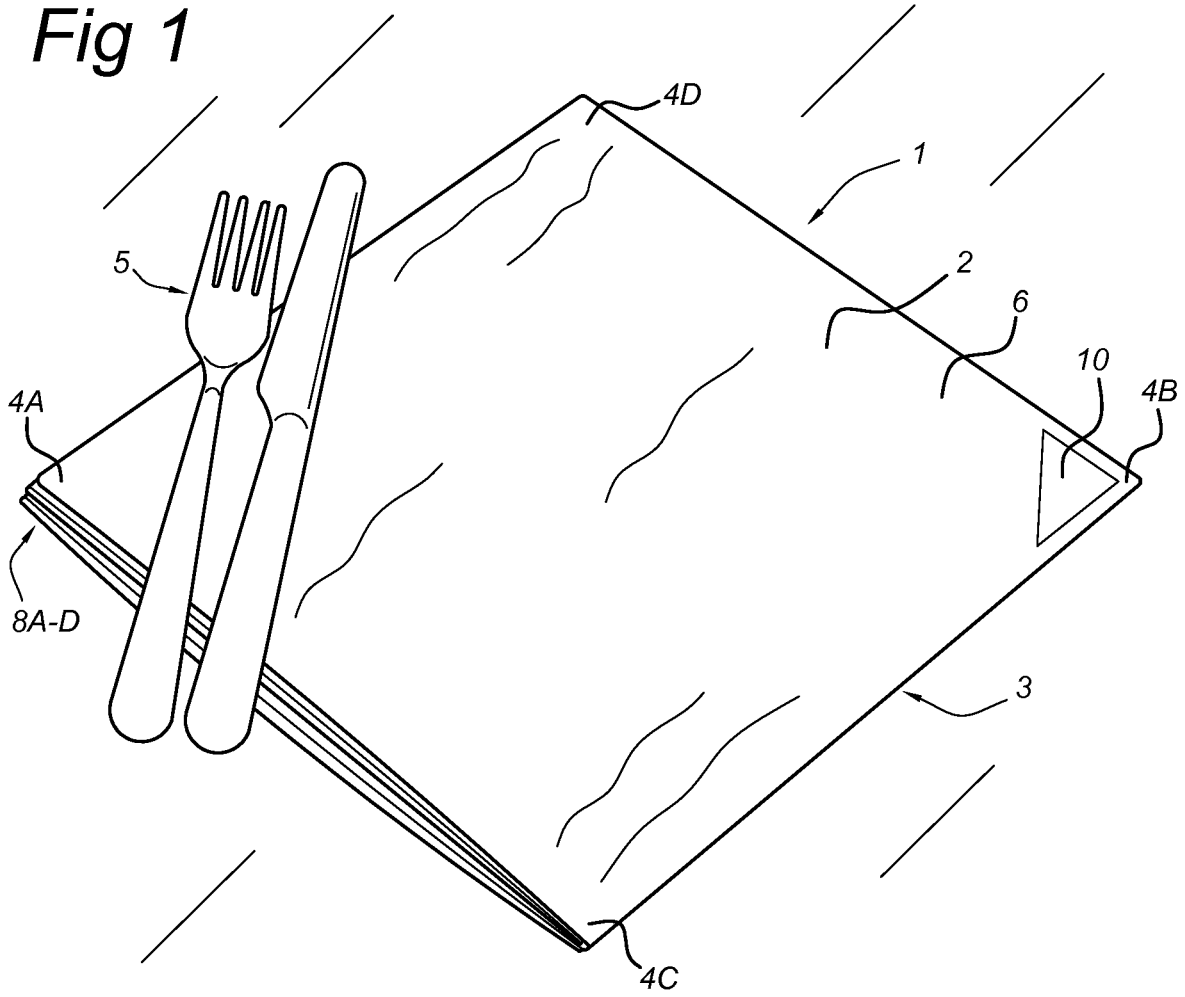
FIG. 1 is a top perspective view of a napkin according to a first embodiment, with cutlery placed on top of the napkin before rolling the cutlery into the napkin.

FIG. 1 shows a schematic view of a napkin 1 according to a first embodiment together with a cutlery service 5. The napkin 1 has an upper side 2 that is visible in FIG. 1 and four corners 4A-4D. The lower side 3 of the napkin 1 is not visible in this view.

The napkin 1 is a conventional 3-ply paper tissue sheet 6 of having a weight of 45 g/m$^2$ and maximum dimensions of 39 cm×39 cm unfolded size. As shown in FIG. 1, the napkin is in a twice folded state, having dimensions of 19.5×19.5 cm. It will be understood that other sizes and constructions may be equally applicable. The points 8A-8D of the tissue sheet are gathered at the first corner 4A. At the diagonally opposite second corner 4B there is provided an adhering portion 10. The adhering portion 10 is a triangular region of 2 cm$^2$ that has been coated with a pressure-sensitive hot melt adhesive, such as Lunatack® PHC 2198 adhesive.

Figure 2:
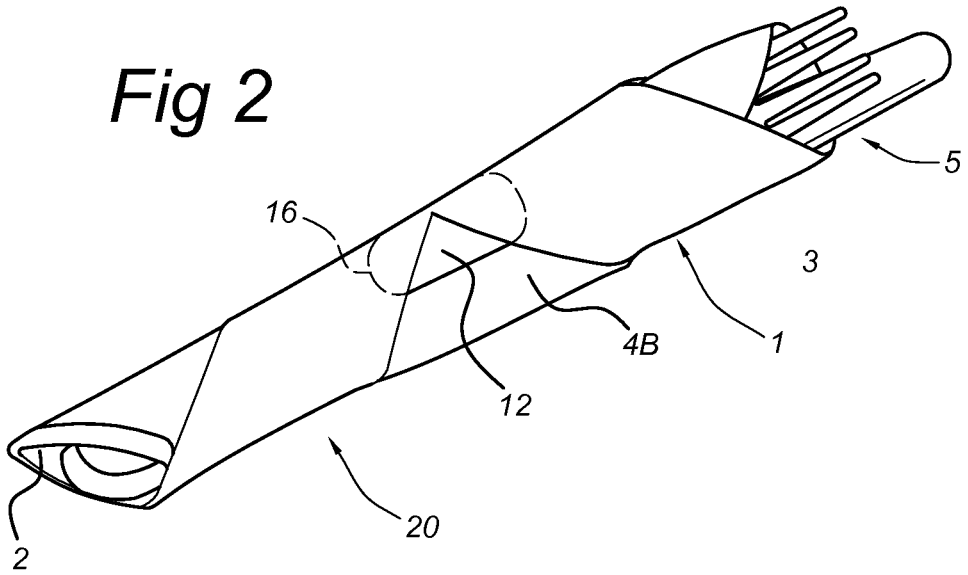
FIG. 2 is a top perspective view of the napkin of FIG. 1, formed into a cutlery wrap after rolling the cutlery into the napkin.

FIG. 2 shows the napkin 1 of FIG. 1, rolled around the cutlery service 5 to form a wrap 20. In this view, the lower side 3 of the napkin 1 is visible, while the upper side 2 of the napkin 1 is turned inwards towards the cutlery service 5. The napkin 1 has been rolled, starting from the first corner 4A and the second corner 4B is outermost. In this state, the adhering portion 10 engages over an engaging location 16 on the lower side 3 of the napkin 1 and engages therewith by the action of the adhering portion 10. The engagement between the adhering portion 10 and the engaging location 16 should be sufficient to secure the wrap 20 against spontaneous unwrapping even after handling of wraps 20 during setting of tables or the like. In particular embodiments, it should also be sufficient to remain engaged for a period of at least 24 hours. On the other hand, it should not be so well adhered that the wrap 20 may not be opened without damaging the napkin 1 to the extent that it may be unacceptable to a user.

Also visible in FIG. 2 is a releasing portion 12 located on the lower side 3 at the second corner 4B, such that it directly corresponds to the position of the adhering portion 10. The releasing portion 12 is provided with a coating of a food grade silicone spray, the function of which will be described in further detail below.

Figure 3:
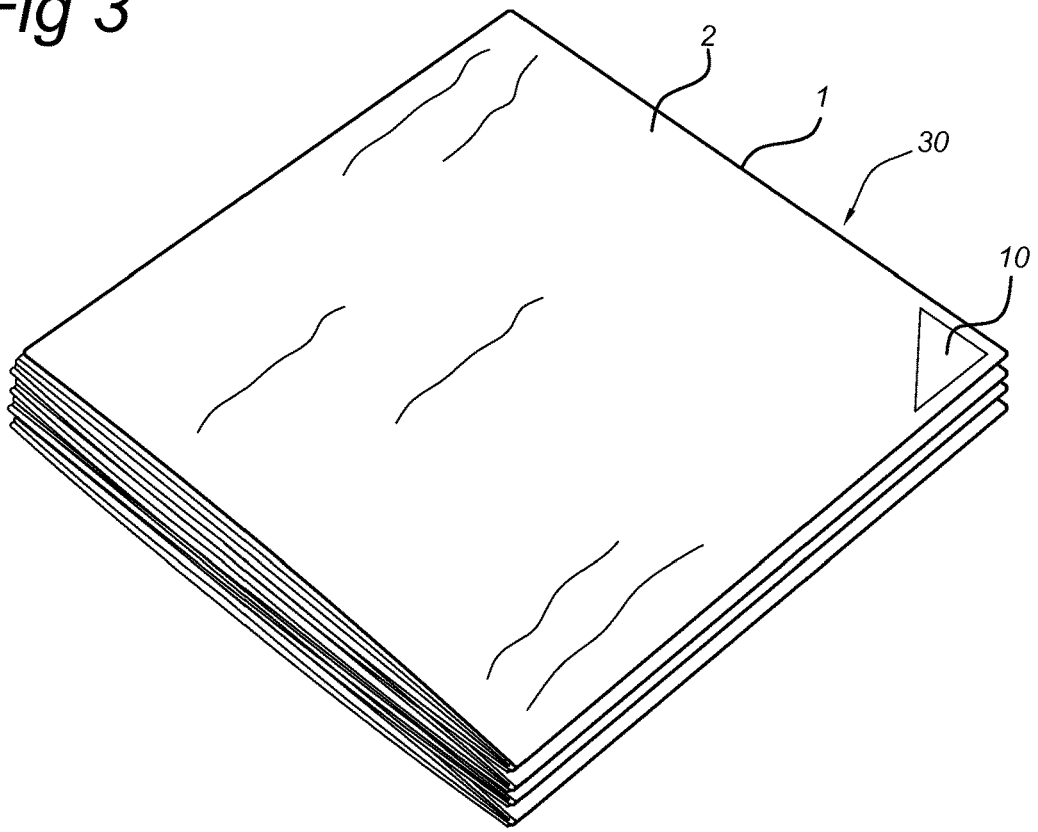
FIG. 3 is a top perspective view of a stack of napkins of the embodiment of FIG. 1.

FIG. 3 shows a stack 30 of napkins 1 according to FIG. 1. All of the napkins 1 in the stack 30 are located with their upper side 2 upwards and the adhering portion 10 of the uppermost napkin 1 is visible.

Figure 4:
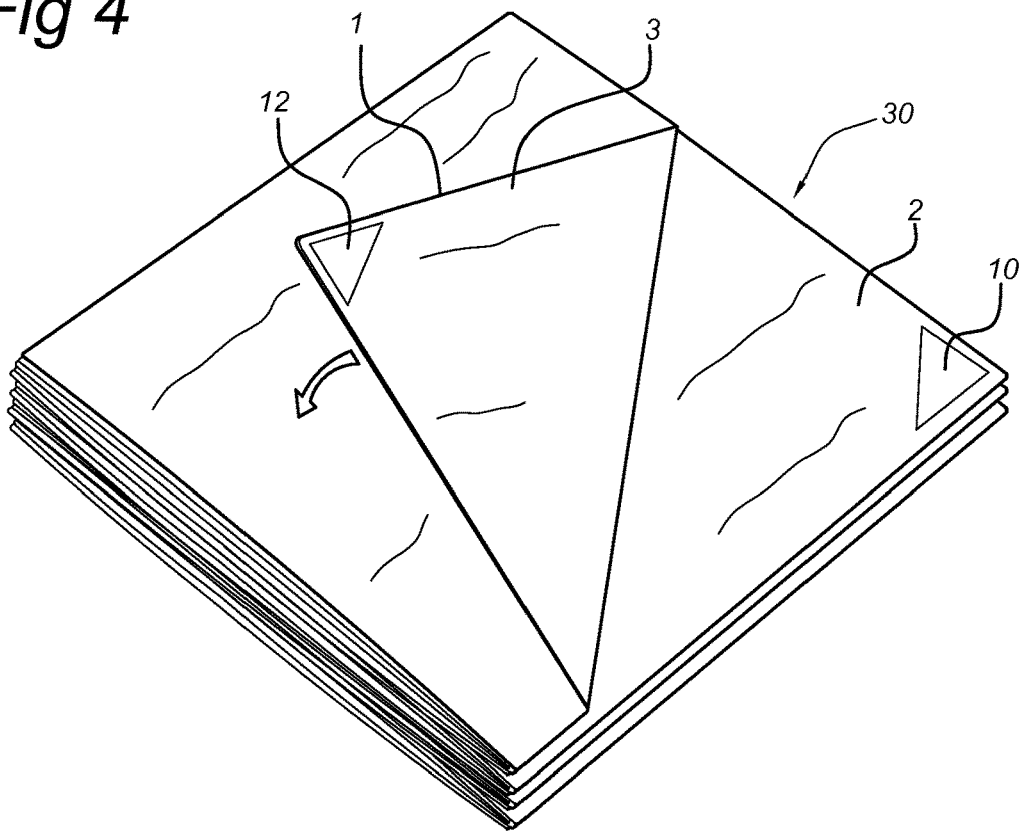
FIG. 4 is a top perspective view of the stack of FIG. 3, with the uppermost napkin partially folded back to reveal additional features.

FIG. 4 shows the stack of FIG. 3, with the uppermost napkin 1 partially turned back to reveal its lower side 3 and the upper side 2 of the napkin 1 below. Also visible is the releasing portion 12 on the lower side 3 of the uppermost napkin 1. It will be understood that the engagement between the adhering portion 10 and the releasing portion 12 allows a stable stack 30 of napkins 1 to be maintained and also ensures that suitable release of the uppermost napkin 1 is possible, without damaging the material of the napkin 1. In this sense, operation may be considered similar to the well-known sticky notes although with the particularity that in the case of the stack 30, the adhering portion 10 is provided on the upper side.

In use, a user may quickly and efficiently form cutlery wraps 20 directly from the stack 30, by placing the cutlery service 5 onto the stack 30 and wrapping or rolling the uppermost napkin 1 from the first corner 4A towards the second corner 4B to the point at which the engaging location 16 engages the adhering portion 10. At this point, continued rolling of the wrap 20, will release it from the stack 30, which is ready to receive the next cutlery service 5.

Figure 5:
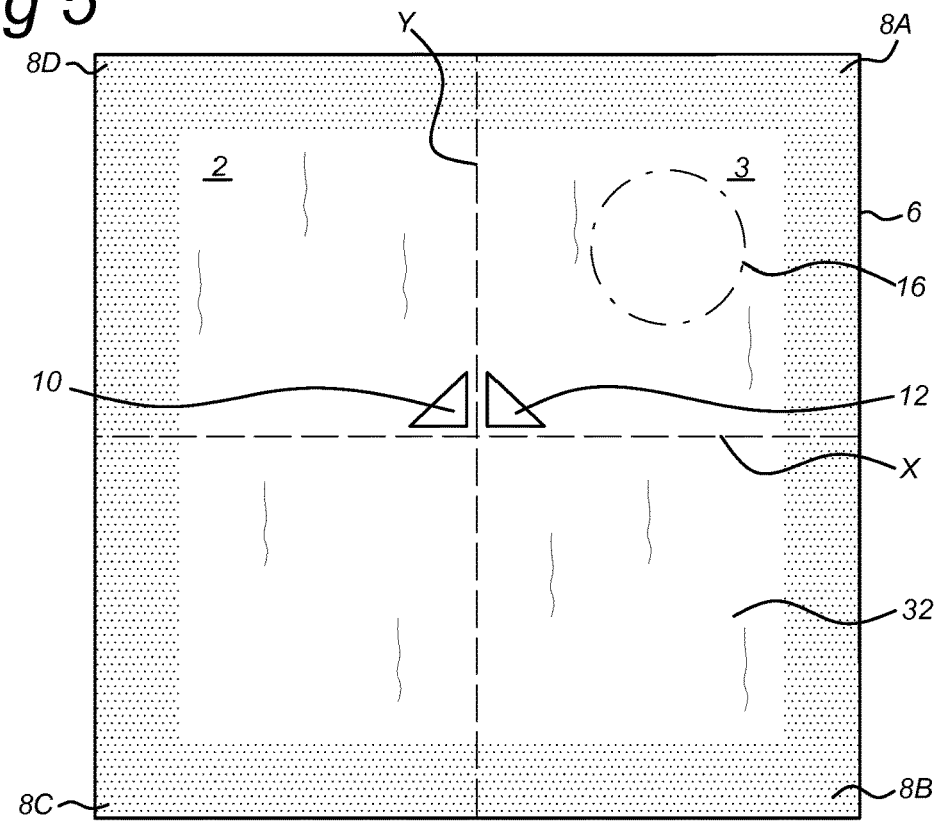
FIG. 5 is a top plan view of an unfolded napkin in accordance with one embodiment.

FIG. 5 is a plan view of the napkin 1 of FIG. 1 after unfolding the tissue sheet 6 to reveal its outer surface 32 and its four points 8A-8D. The sheet 6 is twice-folded, across fold X and subsequently across fold Y to form the napkin 1. The upper side 2 of the napkin 1 is on the left side of the fold Y, while the lower side 3 of the napkin 1 is the portion on the right side of the fold Y. In this embodiment, the adhering portion 10 and the releasing portion 12 are located adjacent to one another on either side of the fold Y and close to the centre of the tissue sheet 6. The engaging location 16 is located centrally of the upper side 2 and as can be seen in this view, is considerably larger than either the adhering portion 10 or the releasing portion 12. The reason for this is that the wrap 20 may vary considerably in size, depending upon the cutlery service 5 and the position at which the adhering portion 10 engages with the lower side 3 of the napkin 1 may also be variable.

Figure 6:
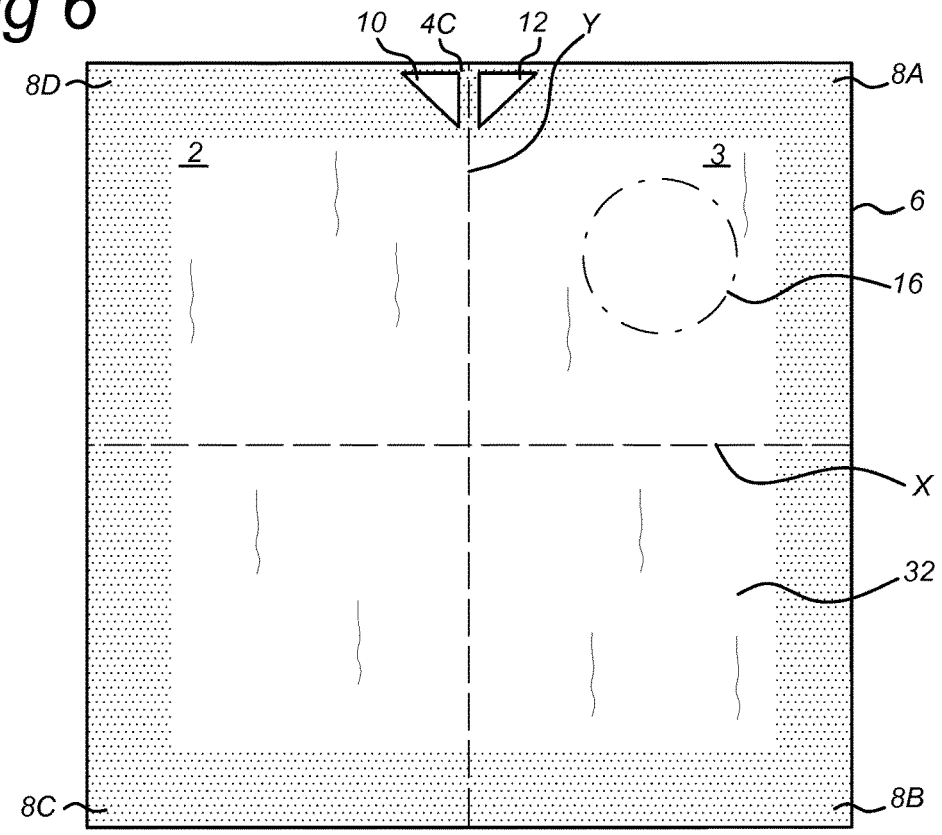
FIG. 6 is a top plan view of an alternative version of the unfolded napkin of FIG. 5, with the adhering portion at a different location.

FIG. 6 is a plan view of a tissue sheet 6 that is otherwise identical to the tissue sheet of FIG. 5, with the exception of the location of the adhering portion 10 and the releasing portion 12. In this case, they are located on opposite sides of the fold Y, adjacent to an edge of the tissue sheet 6. Once the tissue sheet 6 is folded twice to form the napkin 1, the adhering portion 10 and the releasing portion 12 will be found on opposite sides of the third corner 4C. This has the advantage that the adhering portion 10 and the releasing portion 12 are kept away from the central region of the tissue sheet 6, where they might be more visible during use of the napkin.

Figure 7:
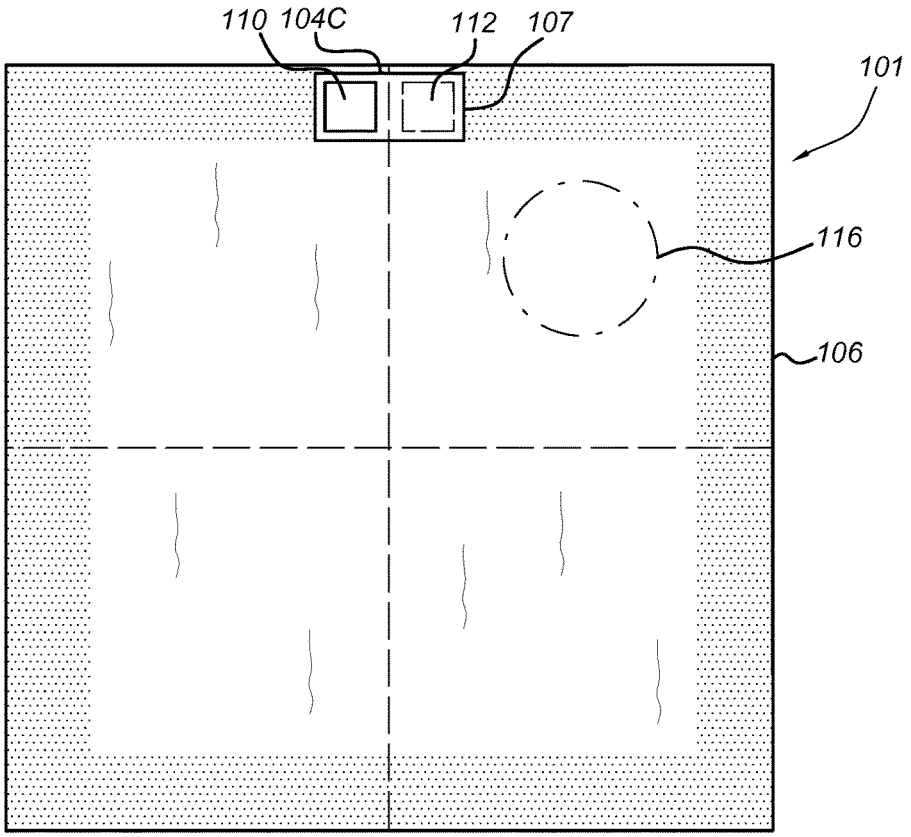
FIG. 7 is a top plan view of another embodiment of an unfolded napkin.

FIG. 7 is a plan view of an unfolded napkin 101 according to an alternative embodiment. Like numerals preceded by 100 are used to designate similar elements. In this embodiment, the tissue sheet 106 is provided with a tape element 107, carrying the adhering portion 110 and the releasing portion 112. In this embodiment, both the adhering portion 110 and the releasing portion 112 are provided on the same tape element 107. It will however be understood that they could also be provided on separate tape elements and could also be spaced from each other. The tape element 107 is permanently adhered to the tissue sheet at the third corner 104C, corresponding to the alternative shown in FIG. 6, and is aligned such that the adhering portion 110 will attach to the engaging location 116. It will be understood that the tape element 107 could have been located at the second corner as in the embodiment of FIG. 5. In all other respects, this embodiment operates in a similar manner to the previous embodiment.

Figure 8:
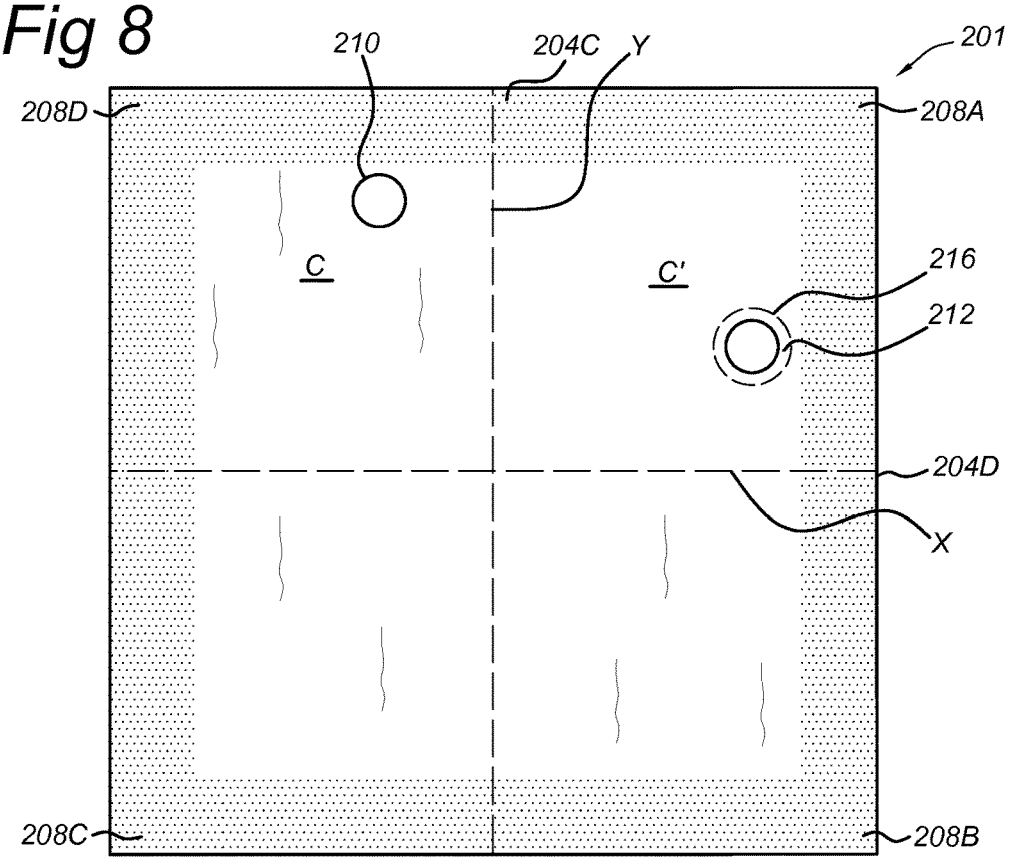
FIG. 8 is a top plan view of a further embodiment of an unfolded napkin.

FIG. 8 is a plan view of an unfolded napkin 201 according to a still further embodiment. Like numerals preceded by 200 are used to designate similar elements to those of the first embodiment. In this embodiment, the adhering portion 210 is moved away from the third corner 204C in a diagonal direction towards the centre C of the napkin 201. In this embodiment, the releasing portion 212 is located at a corresponding distance from what will become the fourth corner 204D, once the napkin 201 is folded, in the direction of the centre C' of the lower side 203 of the napkin. This position of the releasing portion 212 ensures that it can also act as the engaging location if the distance between the adhering portion 210 and the releasing portion 212 corresponds to the wrapping circumference of the cutlery item. In the case of the embodiment of FIG. 8, napkins 201 will be stacked alternately with the third corner 204C overlying the fourth corner 204D of the napkin beneath and vice versa. In this way, the releasing portion 212 will overly the adhering portion 210 of the napkin below.

Thus, the invention has been described by reference to the embodiments discussed above. It will be recognized that these embodiments are susceptible to various modifications and alternative forms well known to those of skill in the art. In particular, the arrangement of adhering portions and releasing portions may be distinct from the schematically illustrated designs both in position and in shape. Accordingly, although specific embodiments have been described, these are examples only and are not limiting upon the scope of the invention.

To this end, the embodiments described above are only descriptions of preferred embodiments of the present invention, and are not intended to limit the scope of the present invention. Various variations and modifications can be made to the technical solution of the present invention by those of ordinary skills in the art, without departing from the design and spirit of the present invention. The variations and modifications should all fall within the claim scope defined by the claims of the present invention.

What is claimed is:

1. A cutlery wrap comprising a napkin, the napkin comprising: an upper side and a lower side; four corners; and an adhering portion and a releasing portion that can releasably adhere together, the adhering portion being located on the upper side and the releasing portion being located on the lower side at corresponding positions such that the napkin can be stacked with similar napkins with the releasing portion on the lower side of a first napkin aligned and engaged with the adhering portion of a second napkin located beneath the first napkin, wherein the napkin further comprises an engaging location on its lower side, wherein the adhering portion and the engaging location are provided with complementary surfaces that releasably adhere to each other but do not adhere to the napkin material, and the adhering portion and the releasing portion are provided with complementary surfaces that releasably adhere to each other but do not adhere to the napkin material, and wherein the napkin is wrapped around one or more items of cutlery and secured by engaging the adhering portion with the engaging location, and the engaging location comprises a protective surface.

2. The cutlery wrap of claim 1, wherein the adhering portion and the releasing portion are located at a first corner of the napkin after the sheet is twice-folded.

3. The cutlery wrap of claim 2, wherein the engaging location is located close to a centre of the napkin after the sheet is twice-folded.

4. The cutlery wrap of claim 1, wherein the napkin is formed from a sheet having an inner surface and an outer surface and being folded at least once with the inner surface inwards, both the adhering portion and the releasing portion being located on the outer surface.

5. The cutlery wrap of claim 4, wherein the sheet is at least twice-folded to form the napkin with the outer surface exposed.

6. The cutlery wrap of claim 5, wherein the releasing portion is provided at a first corner of the napkin after the sheet is twice-folded, the adhering portion is provided adjacent a second corner of the napkin, diagonally opposite to the first corner, and the engaging location is provided between the second corner and a centre of the napkin.

7. The cutlery wrap of claim 5, wherein the releasing portion is provided at a first corner of the napkin after the sheet is twice-folded, the adhering portion is provided adjacent a third corner of the napkin and the engaging location is provided between the third corner and a centre of the napkin, the third corner being an adjacent corner to the first corner.

8. The cutlery wrap of claim 5, wherein the sheet is a multi-ply tissue having a weight per ply of between 14 and 30 $g/m^2$.

9. The cutlery wrap of claim 5, wherein the sheet is a single-ply air-laid non-woven having a weight of between 25 and 80 $g/m^2$.

10. The cutlery wrap of claim 5, wherein the sheet is a single-ply tissue having a weight of between 14 and 40 g/m2.

11. The cutlery wrap of claim 5, wherein the sheet defines a maximum dimension of between 20 cm and 60 cm, when in an unfolded state.

12. The cutlery wrap of claim 4, wherein the outer surface of the sheet is patterned or embossed.

13. The cutlery wrap of claim 1, wherein the adhering portion includes an adhesive that is tacky, and wherein the releasing portion includes a repellent coating or material that releases easily from the tacky adhesive.

14. A stack comprising a plurality of the napkins of the cutlery wrap of claim 1, wherein the napkins are stacked together with the releasing portion on the lower side of a first napkin aligned and releasably engaged with the adhering portion of a second napkin located beneath the first napkin.

15. A method of wrapping cutlery to form a cutlery wrap, the method comprising:

providing a disposable napkin having an adhering portion, an engaging location, and a releasing portion, wherein the adhering portion and the engaging location are provided with complementary surfaces that releasably adhere to each other but do not adhere to the napkin material, and the adhering portion and the releasing portion are provided with complementary surfaces that releasably adhere to each other but do not adhere to the napkin material;

placing one or more items of cutlery onto the napkin;

wrapping the cutlery in the napkin;

engaging the adhering portion with the engaging location on the napkin to secure the wrap, wherein the engaging location comprises a protective surface; and stacking a plurality of napkins in a stack such that the releasing portion on a lower side of each of the napkins is aligned and releasably engaged with the adhering portion, which is located on an upper side of each of the napkins, wherein the upper side of a top napkin in the stack is exposed and the items of cutlery are placed onto the upper side of the top napkin, and wherein the engaging location is on the lower side of the napkins.

16. A napkin, having an upper side, a lower side and four corners, the napkin comprising a twice-folded sheet and being provided with an adhering portion on the upper side, adjacent to one of the corners and a releasing portion on the lower side at a corresponding position to the adhering portion such that a plurality of napkins may be stacked together with the releasing portion of a first napkin engaging releasably with the adhering portion of a second napkin located beneath the first napkin, wherein the napkin further comprises an engaging location on a lower side such that the napkin can be wrapped around an object and secured by engaging the adhering portion with the engaging location and the engaging location comprises a protective surface, wherein the adhering portion and the engaging location are provided with complementary surfaces that releasably adhere to each other but do not adhere to the napkin material, and the adhering portion and the releasing portion are provided with complementary surfaces that releasably adhere to each other but do not adhere to the napkin material.

* * * * *